United States Patent [19]

Bolin

[11] 3,976,392

[45] Aug. 24, 1976

[54] PUMP DRIVE SHAFT SEALING ARRANGEMENT

[76] Inventor: Mauritz Bolin, Nordenskioldsvagen 27, 136 49 Handen, Sweden

[22] Filed: Oct. 18, 1974

[21] Appl. No.: 515,952

[30] Foreign Application Priority Data

Oct. 25, 1973 Sweden ..... 7314528

[52] U.S. Cl. ..... 415/110; 415/113; 415/170 A; 277/33; 277/99

[51] Int. Cl.[2] ..... F04D 29/08; F16K 41/00

[58] Field of Search ..... 415/110, 111, 170 A, 415/113; 277/33, 58, 106, 98, 99

[56] References Cited

UNITED STATES PATENTS

| | | | |
|---|---|---|---|
| 1,007,448 | 10/1911 | Jensen | 277/33 X |
| 1,310,324 | 7/1919 | Cluley | 415/110 |
| 1,845,363 | 2/1932 | Thompson | 415/170 A |
| 2,769,390 | 11/1956 | Heimbuch | 415/111 |
| 3,796,507 | 3/1974 | Smykal et al. | 415/111 |

*Primary Examiner*—Carlton R. Croyle
*Assistant Examiner*—Thomas I. Ross
*Attorney, Agent, or Firm*—Elliott I. Pollock

[57] ABSTRACT

A circulation pump having a comparatively slender drive shaft is provided with an improved axial sealing arrangement to prevent the leakage of circulating liquid through the bore in the pump housing wall in which the drive shaft is supported. The sealing arrangement comprises a pair of bushing-like bodies disposed around the drive shaft between the drive shaft and the wall of the bore, and a pair of pressure elements disposed around the drive shaft and movable in the direction of the shaft abut the sealing elements and are pressed into engagement with the sealing elements by spring means located outside the bore.

4 Claims, 2 Drawing Figures

Figure 1:
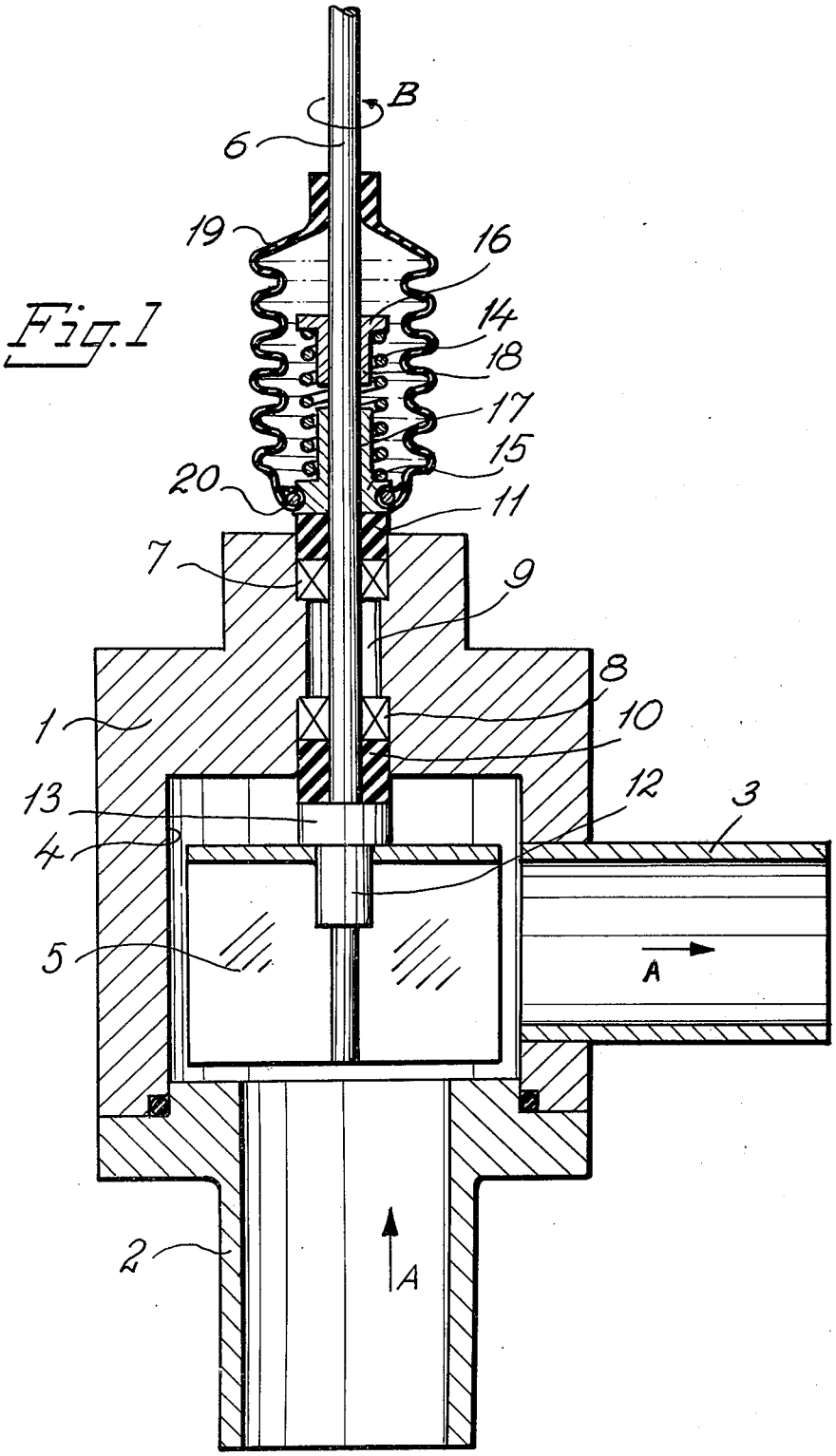

B
6
19
16
14
18
17
15
20
11
7
9
8
10
1
13
12
3
4
5
A
2
A

6'
16'
18'
14'
17'
15'
24
22
23
2'
21
1'
28
4
25
27
26
5'
3'

PUMP DRIVE SHAFT SEALING ARRANGEMENT

The present invention relates to a pump to be used in circulation systems where limited current supply exists for driving the pump.

Examples of application fields with only low current supply, where the present invention is particularly applicable, are heating circulation systems in boats, caravans, cars or the like. The pump must, due to the low current supply, of necessity be made with small dimensions. This has caused special problems concerning particularly the sealing in the pump for preventing leakage and ejection of liquid out of the pump house around the slender drive shaft for driving the pump impeller. No solution of the sealing problem has heretofore been disclosed and it has been necessary to utilize in these connections only open circulation systems with the disadvantages belonging thereto. Among other things, a distinct location of the pump has been required. Thus, in such known circulation systems it has been necessary to locate the pump at the same level as the expansion vessel of the circulation system. It is true, that hereby the sealing may be omitted, but risk for higher noise level and leakage due to overboiling arises and besides, the drawing of the pipe lines becomes more complicated and expensive. In one known such circulation system the pump has been placed within the expansion vessel, while in another known such circulation system the pump has been placed on a level with but outside the expansion vessel. In order not to be bound to said location or in order to be able to use a closed circulation system attempts have been made to obtain a sealing by means of conventional sealings used in larger pumps, for instance O-rings or spring-loaded rubber sealings arranged between the drive shaft and the wall of the bore surrounding the drive shaft. In the present connection, however, the slender drive shaft dimensions and the great requirements on precision dependent thereof have made it impossible to use O-rings or the spring-loaded sealings structurally complicated at the dimensions in question. Furthermore, small O-rings provide only a small abutment surface and accordingly exhibit major problems of wear.

The present invention gives the solution of the above mentioned sealing problems existing at the small dimensions in question.

Thus, the present invention relates to a pump to be used in circulation systems with low current supply for driving the pump, particularly for heating circulation systems in motor boats, caravans, cars and the like, including a pump housing defining a pump chamber, at least one pump impeller arranged in the pump housing, a pump shaft connected to the pump impeller for the drive thereof, which drive shaft extends through a bore in the pump housing wall out of the pump housing and is driven by a low power source, and at least one sealing element arranged in the bore for preventing leakage of the circulation liquid through the bore.

The pump according to the invention is characterized in that said sealing element is in the form of a bushing-like body arranged around the drive shaft between the drive shaft and the wall of the bore and in the direction of the drive shaft between an abutment fixed relative to the bore and a pressure element arranged in said direction movably relative to the abutment, and that a spring means located outside the bore is arranged to press the pressure element in the direction of the drive shaft against the sealing element.

The present invention makes a very simple design possible, and nevertheless provides a tight sealing for drive shafts having the slenderest possible dimensions. This is also the case for closed circulation systems having an interior overpressure in the pump chamber. By the arrangement of the pump according to the invention having said "axial sealing" in a closed circulation system also the advantage is gained, that the higher the pressure in the pump chamber is the better becomes the sealing. Thus, the pump according to the invention can, as distinguished from previously known pumps, be used also in closed ciculation systems in this application field. The fact is, that the pump according to the invention has made closed circulation systems possible to use also when only low current supply exists. A closed circulation system means simpler and cheaper pipe installation. Furthermore, the pump according to the invention can be positioned at a selected convenient place in the circulation system - open or closed. Besides the fact, that previously only open circulation systems could be used, the pump must, as described above, be positioned in level with the expansion vessel, which often from space and maintenance point of view could be troublesome. Furthermore, the pump according to the invention can easily be inserted at a convenient place in already existing circulation systems. In a preferred embodiment the sealing element is arranged at the end part of the bore and extends partly out of the bore.

In another preferred embodiment two sealing elements are arranged spaced apart at the bore, wherein said spring means affects both sealing elements. Hereby a further step has been taken in order to guarantee a reliable sealing. However, in spite of the provision of two sealing elements, the design is simple due to the fact that the same spring means affects both sealing elements.

Figure 2:
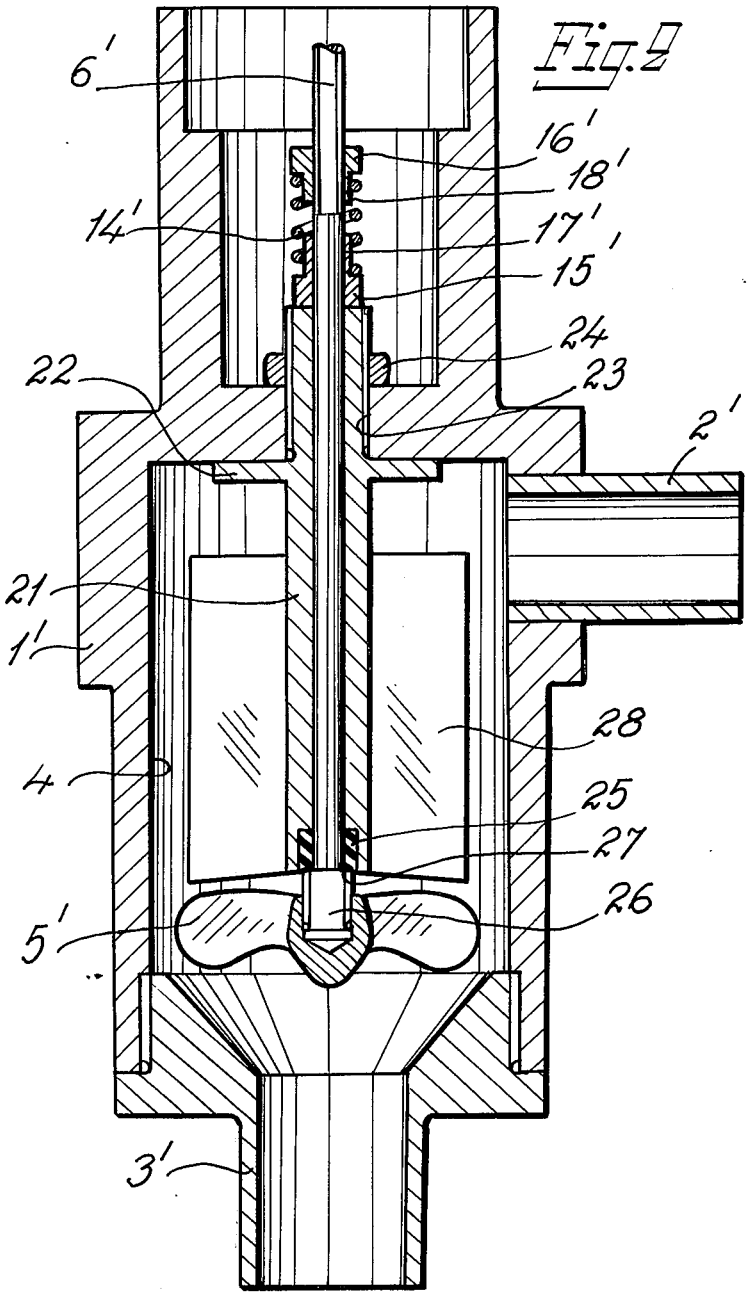

Further characteristics of the pump according to the invention will be evident from the following description with reference to the accompanying drawings in which:

FIG. 1 is a schematic cross-sectional view of a first embodiment of the present invention, and FIG. 2 is a schematic cross-sectional view of a second embodiment of the invention.

The pump shown in FIG. 1 comprises a pump housing 1. An incoming pipe 2 and an outgoing pipe 3 for the liquid flow, the direction of which is shown with arrows A, are drawn to the pump housing. A pump impeller 5 is arranged in the chamber 4 of the pump housing. The pump impeller is fixed on a drive shaft 6 for driving the impeller. The drive shaft extends through inner and outer bearings 7 and 8 resp., which are fixed in a bore 9 formed in the pump housing wall. The drive shaft is driven in the direction of arrow B by a low power source (not shown), for instance a motor. A sealing bushing 10 engages the inner surface of the bearing 8 and a sealing bushing 11 engages the outer surface of the bearing 7. The bushings consist of a suitable material, for instance a plastic material such as teflon. In the embodiment shown, the bushings project partly out of the bore 9.

A socket 12, consisting of for instance stainless steel, is fixed on the drive shaft 6, for instance by shrinking-on, and is provided with a flange 13. Instead of socket 12, the drive shaft can be formed in one piece in a corresponding way. The flange 13 is held pressed against the sealing bushing 10 by means of a spring means 14, which in the embodiment shown comprises a coil pressure spring arranged about the drive shaft outside the pump housing and between flanges 15 and 16 on guide cylinders 17 and 18 respectively. The cylinder 17 is movably arranged relative to the drive shaft 6, while the cylinder 18 is fixed relative to the drive shaft.

By the pressing engagement between the sealing bushing 10 and the flange 13 of the socket 12, caused by the spring 14, a sealing has been created in the direction of the drive shaft ("axial sealing") against leakage through the bore 9. Furthermore, the higher pressure existing in the pump chamber 4 causes a better sealing to be achieved.

As shown in FIG. 1, there is a further sealing between the flange 15 of the cylinder 17 and the outer surface of the sealing bushing 11. This sealing is also affected by means of the pressure spring 14, which presses the flange 15 against the outer surface of the sealing bushing 11.

Between the sealing surfaces of the flange 13 and the sealing bushing 10 as well as between the sealing surfaces of the flange 15 and the sealing bushing 11, a separate sealing element may, if so desired, be inserted.

The cylinder 17 accordingly serves as pressing means against the sealing bushing 11 as well as guide means for the spring 14, while the cylinder 18 only serves as guide means for the spring.

The pump shown in FIG. 1 further includes a bellows-like elastic device 19 of suitable material such as rubber, which by means of a lock ring 20 is tightly fixed at the flange 15 of the cylinder 17 and tightly surrounds the drive shaft 6 above the spring 14. The bellows-like device 19 is provided as an additional precautionary measure for the exceptional event that liquid should leak through the bore 9 past the cylinder 17 movably arranged relative to the drive shaft.

A test over a long period of time was carried out for a pump according to FIG. 1 (however, without the bellows-like device 19) provided in a closed circulation system of normal length adapted for caravans and boats, i.e. about 20 m pipe length, and having a consumption of about 1 milliampere/liter water and hour. In such a circulation system about 140 liter was circulating and the consumption was accordingly 140 milliampere/hour. The circulation time was about 2–3 minutes and the temperature difference between the raising pipe and the return pipe was about 6°C. A thermostat was provided in the raising pipe and open at about 85°C. During the test a pump was used having a 2 mm drive shaft 6 and 4 mm teflon bushings 10 and 11. Complete sealing was established during the whole long time test. Furthermore, for teflon material an allowable pv-factor (pressure x velocity-factor) of 1.4 is valid. During the test a pressure of 2 kp/cm$^2$ was measured, which at existing number of revolutions has a corresponding pv-factor of 0.35. Thus, this means also a fourfold degree of safety, i.e. up to 8 kp/cm$^2$ is allowable.

It should be noted, that in circulation systems wherein higher power motor outputs are available larger drive shafts dimensions are permitted, for instance more than 6 mm diameter, and in these cases there are compared with the "axial sealing" according to the invention equivalent sealing possibilities, for instance "radial" sealing by means of O-rings or structurally more complicated spring-loaded rubber sealings. These "radial sealings", however, are from an accuracy point of view and also from a wearing point of view not possible to use within the field the pump according to the invention is adapted to be used, viz. in circulation systems having low current supply for driving the pump, for instance heating circulation systems in boats, caravans, cars or the like. In such circulation systems low starting torque and easy running is required, which for instance for the drive shaft means a dimension of at least less than 6 mm. With these small dimensions it has not been possible to attain satisfactory sealing when using previously known sealing devices.

It should furthermore be noted, that in certain cases satisfactory sealing can be accomplished by having only sealing at either of the seaing places between the elements 10, 13 or 11, 15, although obviously in these cases cannot be guaranteed as reliable total sealing as in those cases where two sealing elements in accordance with the pump shown in FIG. 1 have been provided.

FIG. 2 shows an example of a pump according to the invention provided with only an inner sealing corresponding to the sealing between the elements 10 and 13 in the embodiment of FIG. 1. The pump housing is here designated as 1', the incoming pipe as 2', the outgoing pipe as 3', the pump chamber as 4', the impeller (in this case examplified as a propeller) as 5' and the drive shaft as 6'. In this embodiment the drive shaft is journalled in a cylinder 21 provided with a flange 22. The cylinder extends through a bore 23 formed in the pump housing wall and is fixed to the pump housing by means of the flange 22 and a nut 24. The cylinder 21 is at the inner end provided with a bushing 25 of suitable material, for instance teflon. An enlarged portion 26 of the shaft engages the bushing. The enlarged portion may on the surface 27 engaging the bushing be provided with for instance teflon material and can be conical (as shown) or formed radially straight. The surface 27 is held pressed against the bushing 25 by means of a spring device 14'–18' corresponding to the spring device 14–18 shown in FIG. 1. However, the outer stop and guide cylinder 16', 18' comprises a set nut to make a setting of the spring force possible. Furthermore, the part of the cylinder 21 located within the pump chamber 4' is shown to have wings or guide plates 28 in order to prevent the liquid from gyrating in this part of the chamber.

In the embodiments shown, the pump is provided with only one impeller. However, more than one impeller can be arranged on the drive shaft. Furthermore, although not shown, the embodiment according to FIG. 2 may also be provided with an outer sealing corresponding to the sealing 11, 15 of FIG. 1 and may also be provided with a bellows-like device corresponding to the device 19 shown in FIG. 1. Also further variations are possible within the scope of the following claims.

What I claim is:

1. A pump to be used in a heating circulation system in boats, caravans, cars and the like having a low current supply for driving the pump, said pump including a pump housing defining a pumping chamber, a circulation liquid inlet conduit connected to said pumping chamber, a circulation outlet conduit connected to said pumping chamber, a pump impeller located in said pumping chamber for effecting the ciculation of the liquid in said system, a bore through one wall of said pump housing, a drive shaft extending through said bore and drivingly connected with said pump impeller to effect rotation of said impeller upon rotation of said drive shaft, drive means energized by said low current supply, said drive means being connected to said drive shaft at a location outside of said housing for effecting said rotation, means fixed in said bore for supporting said drive shaft relative to said pump housing, two sealing elements located at opposite ends of said bore and extending partly out of said bore, said sealing elements comprising a pair of bodies which, as seen in the direction of said drive shaft, respectively abut said supporting means on opposite surfaces thereof and also abut said drive shaft and the wall of said bore, two pressure elements disposed around said drive shaft, said pressure elements being movable in the direction of said drive shaft and respectively abutting the surfaces of said sealing elements opposite to the surfaces thereof which abut said supporting means, and a spring means located outside said bore and arranged to press both of said pressure elements against said sealing elements, thereby to prevent leakage of the circulating liquid through said bore.

2. The pump of claim 1 wherein a portion of said drive shaft projecting out of said pump housing is covered by an elastic cover surrounding said drive shaft at a position closely adjacent said bore.

3. The pump of claim 2 wherein said cover is fixed to one of said pressure elements.

4. The pump of claim 3, wherein said spring means is positioned between said one of said pressure elements and a stop element which is fixed relative to said drive shaft and located further out from said bore.

* * * * *